United States Patent [19]

Adkins

[11] Patent Number: 5,013,066

[45] Date of Patent: May 7, 1991

[54] SKI POLE HOLDER

[76] Inventor: Keith W. Adkins, S. 11 Barker Rd., Green Acres, Wash. 99016-9704

[21] Appl. No.: 451,819

[22] Filed: Dec. 15, 1989

Related U.S. Application Data

[63] Continuation-in-part of Ser. No. 223,924, Jul. 25, 1988, Pat. No. 4,936,602.

[51] Int. Cl.[5] ..... A63C 11/00

[52] U.S. Cl. ..... 280/809; 211/70.5; 280/814

[58] Field of Search ..... 280/819, 815, 814, 809; 248/110, 230; 211/70.5; 224/917, 42.45 R, 251; 294/147; 104/173.2; 297/188, 191, 194

[56] References Cited

U.S. PATENT DOCUMENTS 4,033,460 7/1977 Alexandre ..... 211/70.5

4,396,138 8/1983 Kirschner ..... 211/70.5

4,620,722 11/1986 Dunn ..... 280/814

4,793,496 12/1988 Wait ..... 211/70.5

FOREIGN PATENT DOCUMENTS 2496029 6/1982 France ..... 104/173.2

*Primary Examiner*—Andres Kashnikow

*Assistant Examiner*—Eric Culbreth

*Attorney, Agent, or Firm*—Klarquist, Sparkman, Campbell, Leigh & Whinston

[57] ABSTRACT

A ski pole holder is mounted to a ski lift and secures a skier's ski poles during the ski lift ride. In a first embodiment, a resilient holder secures the ski pools vertically by supporting the ski pole handle from below. In a second embodiment, the holder comprises a pair of resilient bodies adapted for mounting to the ski lift and supporting the ski pole horizontally.

4 Claims, 3 Drawing Sheets

SKI POLE HOLDER

CROSS REFERENCE TO RELATED APPLICATIONS

This application is a continuation-in-part of U.S. patent application Ser. No. 07/223,924, filed July 25, 1988 by Keith W. Adkins, now U.S. Pat. No. 4,936,602.

The present invention relates generally to ski equipment and particularly to a ski pole holder for attachment to a ski lift.

BACKGROUND OF THE INVENTION

Skiers, who ride open ski lifts to the top of a ski run, must often carry their ski poles in hand or sit upon the poles as they ride. Such open ski lifts include chair-like structures suspended from a moving cable. It is important to keep a firm hold on the ski poles while riding the ski lift. If the poles fall to the ground, the skier has no way immediately to retrieve the poles. Some ski poles have hook-like handle structures adapted to hang from the frame of the ski lift, but most ski poles do not have this capability. For most skiers, the ski lift ride offers an opportunity to prepare for the next run. Examples of such activities include adjustment of ski clothing, application of lip ointment, and cleaning foggy goggles. These activities are hampered by the need to keep a firm hold on the ski poles, and many skiers drop their poles.

SUMMARY OF THE PRESENT INVENTION

In accordance with a first embodiment of the present invention, a ski pole holder attaches to a ski lift and includes a formation for slidably receiving a rod section of a ski pole, while supporting the ski pole handle from below, so as to permit the ski pole to hang upon the holder during a ski lift ride.

In accordance with a second embodiment of the present invention, a ski pole holder attaches to a ski lift and includes formation for receiving a rod section of a ski pole while supporting the ski pole horizontally. A pair of such holders mounted upon the lift in horizontal alignment support the front and rear portions of the rod section of the ski pole. The holders may be dimensioned to receive the rod section of the ski pole, but restrict longitudinal movement of the ski pole along the axis of its rod section.

In accordance with one aspect of the present invention in either of the above-noted embodiments, the pole holder may be resilient. Such resiliency allows the holder to deform as the pole is inserted through an entry passage of the holder, thereby serving to capture the pole within the holder. Also, in the event that the poles drag upon the ground or strike an object, the poles will not bend or fall from the holder.

The subject matter of the present invention is particularly pointed out and distinctly claimed in the concluding portion of this specification. However, both the organization and method of operation, together with further advantages and objects thereof, may best be understood by reference to the following description taken in connection with the accompanying drawings, wherein like reference characters refer to like elements.

DETAILED DESCRIPTION OF A PREFERRED EMBODIMENT

Figure 1:
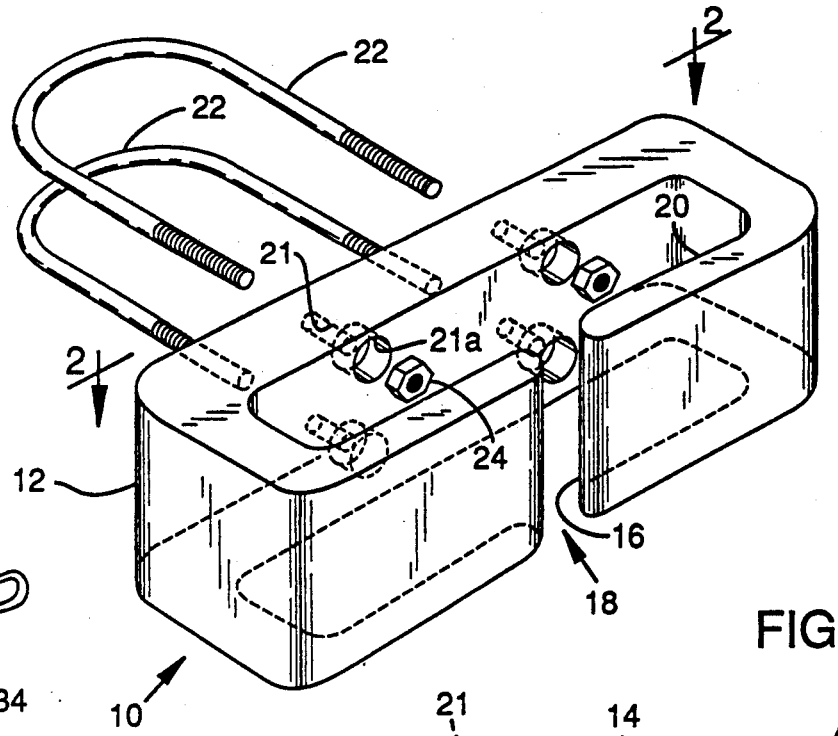
FIG. 1 is an exploded perspective view of a first ski pole holder, according to the present invention.
Figure 2:
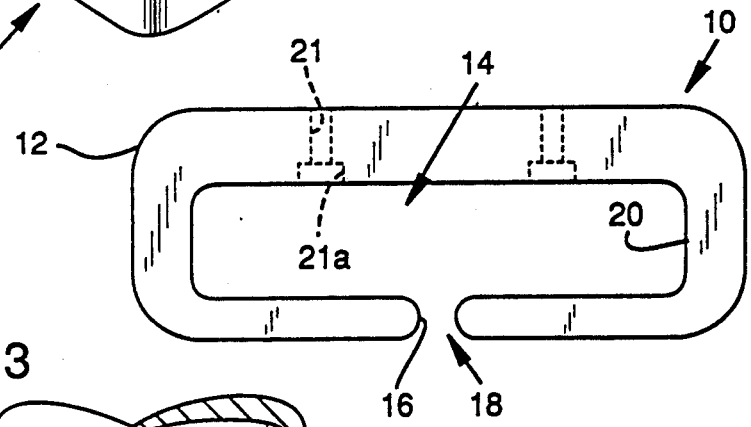
FIG. 2 is a top view, taken along lines 2—2 of FIG. 1, of a portion of the ski pole holder shown in FIG. 1.
Figure 3:
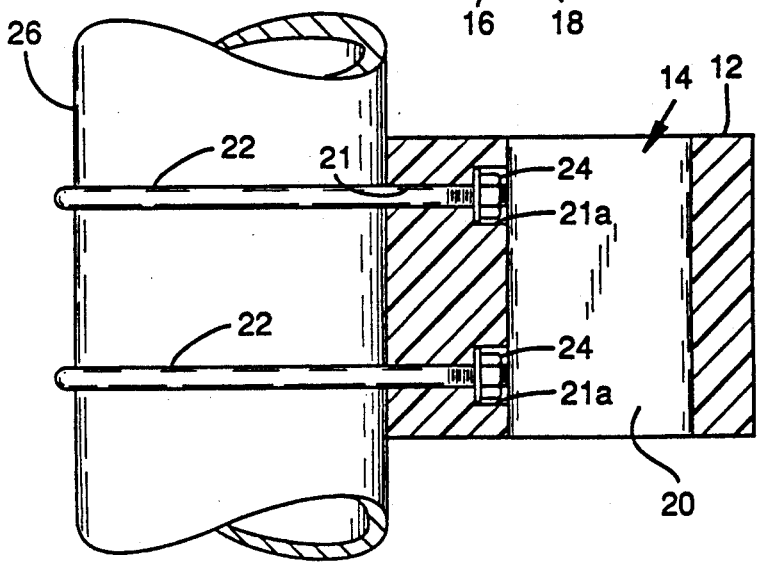
FIG. 3 is a cross-sectional side view of the ski pole holder of FIG. 1, shown assembled and attached to a ski lift.

With reference to FIGS 1-3, a ski pole holder 10, according to a first embodiment of the present invention, includes a resilient retainer body 12 having a T-shaped inner formation 14. Formation 14 includes an entry passage 16 defining an opening 18 and a retention passage 20 intersecting passage 16, where passage 16 corresponds to the vertical base of the T-shape and passage 20 corresponds to the horizontal cross portion of the T-shape. Holder 10 is manufactured by an extrusion process producing lengths of rubber compound having a substantially square exterior cross section, with formation 14 appearing as a T-shape in lateral cross section. The lengths of extruded rubber compound are cut in segments, and each segment forms a body 12. Body 12 is then provided with mounting apertures 21 through which U-bolts 22 are inserted with nuts 24 being used to secure bolts 22 to holder 10. Apertures 21 are counter-sunk, as at 21*a*, to accommodate nuts 24 and maintain passage 20 clear. Holder 10 is mounted upon upright 26 (FIG. 3) by capturing upright 26 within the bight of bolts 22, inserting bolts 22 through apertures 21 and threading nuts 24 upon bolts 22.

Figure 4:
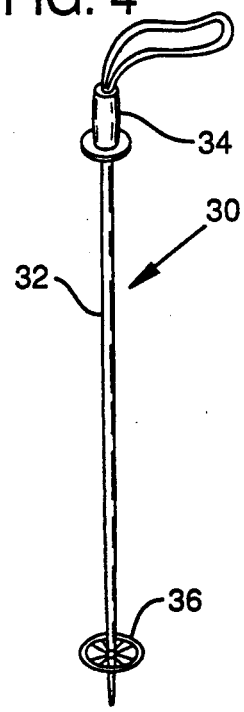
FIG. 4 illustrates a ski pole.

Referring to FIG. 4 in conjunction with FIGS. 1-3, ski pole 30 includes rod section 32 with handle 34 at its upper end and basket 36 at its lower end. Rod section 32 is of smaller diameter than the lower portion of handle 34, and formation 14 is wide enough to permit insertion of rod section 32 within passages 16 and 20 by way of opening 18, i.e., by lateral movement of pole 30, yet is narrow enough to prevent the lower portion of handle 34 from entering formation 14, i.e., by downward axial movement of pole 30, once rod section 32 is inserted in formation 14. Thus, rod section 32 is slidably received both axially and laterally within formation 14. Also, handle 34 is supported from below by the upper surface of holder 10.

Figure 5:
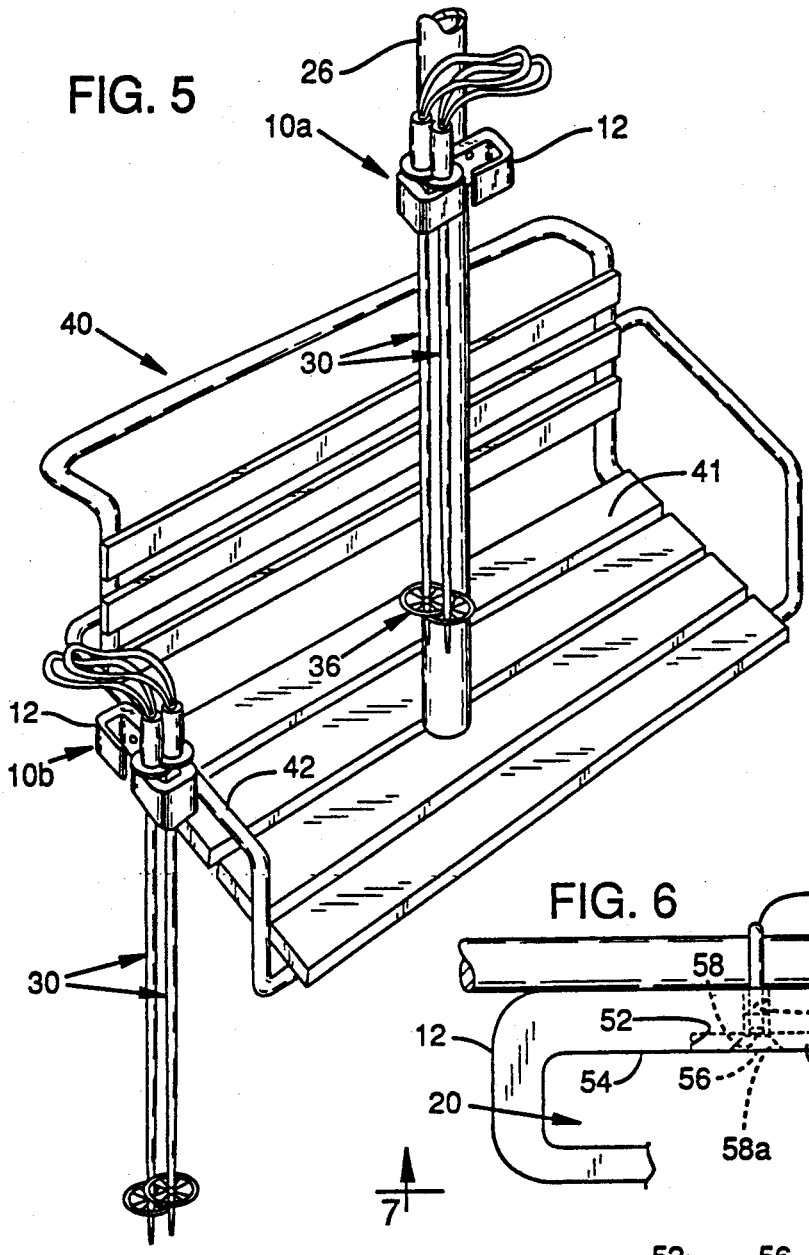
FIG. 5 is a perspective view of an open ski lift, showing mounting locations upon the ski lift for the ski pole holder of FIG. 1, and showing ski poles held within the ski pole holder.

FIG. 5 illustrates preferred mounting locations for holder 10 upon ski lift 40. In FIG. 5, holder 10*a* is affixed to upright 26 at sufficient height above seat 41, such that when ski poles 30 are held within holder 10, baskets 36 are above seat 41. Holder 10*b* is mounted to arm rest 42 of lift 40 and the orientation of bolts 22 in apertures 21 may be adjusted to accommodate the structure of arm 42. Thus, where holder 10*a* has horizontally aligned apertures 21 for each U-bolt 22, holder 10*b* requires vertically aligned apertures 21 for each U-bolt 22.

Ski runs may be full runs, where the lift carries the skiers from the bottom of the run to the top without any intermediate stops or unloading stations, or may include intermediate unloading stations, where the lift comes close to the ground or snow level to permit skiers to get off as the lift passes through. For lifts with intermediate unloading stations, the locations shown for holder 10*a* is advantageous, as it is undesirable to allow baskets 36 to drag as the ski lift passes near ground level. For lifts without intermediate unloading stations, the location of holder 10*b* may be preferred as this location is more convenient.

Holder 10 may be resilient. Even if poles 30 drag upon the ground or strike an object while held within holder 10, holder 10 will bend to avoid damage to the poles.

Figure 6:
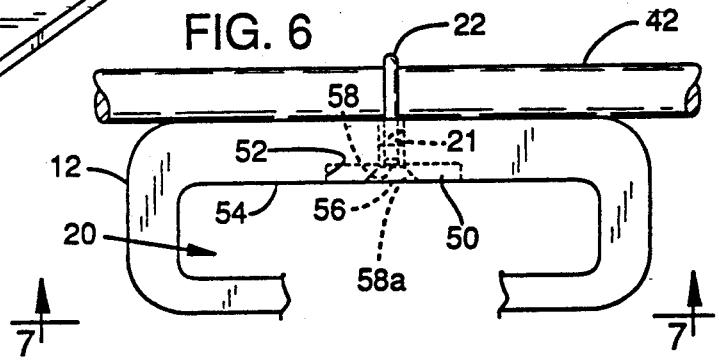
FIGS. 6 and 7 show an alternate method of securing the holder of FIG. 1.
Figure 7:
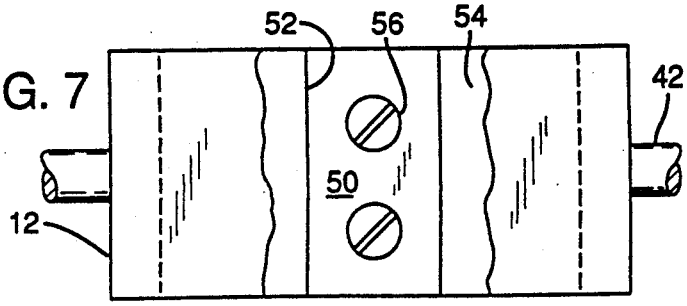

FIGS. 6 and 7 illustrate a second method of securing holder 10, wherein a galvanized steel plate 50 is positioned within an inset 52 at the back wall 54 of passage 20 and nuts 24 (FIGS. 1–3) are replaced by flat head nuts 56. Apertures 21 are straight bores through body 12 and are aligned with apertures 58 in plate 50 which are counter-sunk, as at 58*a*, to accommodate flat head nuts 56, nuts 56 being threaded internally for connection to bolts 22. Holder 10 is mounted to arm 42 by capturing arm 42 within the bight of bolts 22 and inserting bolts 22 through apertures 21. Plate 50 is positioned within inset 52 by inserting bolts 22 through apertures 58 and threading nuts 56 upon bolts 22. In this configuration, the threaded portions of bolts 22 are well protected within body 12 and nuts 56 while plate 50 is flush with the back wall 54 of passage 20, leaving passage 20 clear for unencumbered retention of ski poles. It is understood that the mounting arrangement shown in FIGS. 6 and 7 may be used to mount holder 10 upon a vertical structure, such as upright 26 of FIG. 3, by horizontal alignment of apertures 21, as shown in FIG. 1.

In operation, skiers board lift 40 with their poles in hand, and once seated upon the lift, they place the poles within holder 10 by slipping rod section 32 through opening 18, through passage 16 and into retention passage 20. Retention passage 20 is dimensioned to accommodate a number of poles depending on the number of passengers the lift is designed to carry. Ski lift 40 carries two passengers, and retention passage 20 is dimensioned to fit four ski poles. Alternately, each holder 10 could be dimensioned to hold two poles, and separate holders 10 can be mounted on each arm 42 of lift 40.

Figure 8:
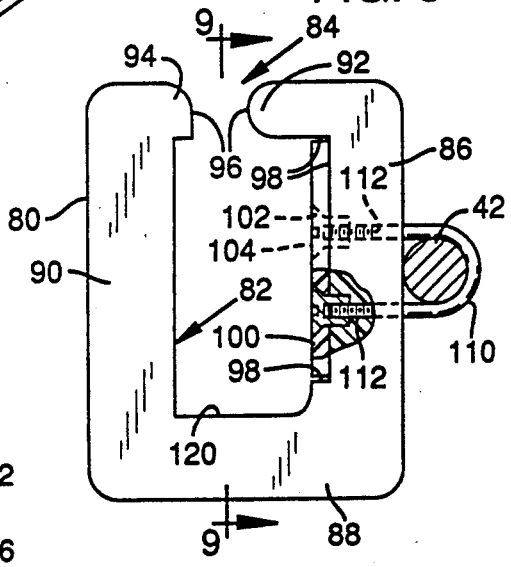
FIG. 8 is an end view of a second embodiment of the present invention, shown attached to a ski lift and adapted to secure ski poles upon the ski lift horizontally.
Figure 9:
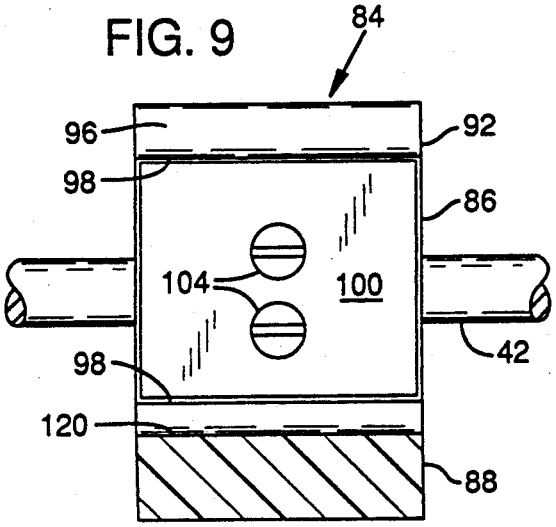
FIG. 9 is a front, sectional view of the holder of FIG. 8, taken along lines 9—9 of FIG. 8.

FIG. 8 illustrates a second embodiment of the present invention, adapted to attach to a ski lift and support ski poles horizontally. This second embodiment comprises a resilient retainer body 80 having a substantially rectangular exterior cross-section and a substantially rectangular inner formation 82. An upper entry passage 84 allows placement of the rod section 32 of ski pole 30 within the space defined by inner formation 82 by downward lateral movement of ski pole 30. Thus, as seen in the end view of FIG. 8, body 80 comprises a generally U-shaped element having an open upper end and a closed lower end. More particularly, body 80 includes an inner wall 86, a lower wall 88 and an outer wall 90. Inner wall 86 and outer wall 90 are substantially vertical, parallel relative to one another, and joined by lower wall 88, which is substantially horizontal. Retention protrusions 92 and 94 extend from the upper ends of inner wall 86 and outer wall 90, respectively. Each of protrusions 92 and 94 include rounded, opposing faces 96 defining entry passage 84.

Inner wall 86 is adapted for attachment to a ski lift. As seen in FIG. 8, inner wall 86 is attached to arm 42, seen in cross section, of a ski lift. The interior surface of inner wall 86 defines an inset formation 98 dimensioned to receive closely a galvanized steel plate 100. Inset formation 98 corresponds in depth to the thickness of plate 100. The exposed surface of plate 100 is then flush with the remainder of the interior surface of inner wall 86, whereby a substantially rectangular, smooth ski pole retaining space is defined. Galvanized plate 100 includes counter-sunk apertures 102 for receiving flat head nuts 104. Nuts 104 are then flush with the inner exposed surface of plate 100. A U-bolt 110 surrounds, at its bight portion, the arm 42 of the ski lift and extends through vertically aligned mounting apertures 112 of inner wall 86 and through apertures 102 of plate 100. Nuts 104 are then threadably engaged with U-bolt 110 to capture inner wall 86 between plate 100 and arm 42, thereby securing body 80 to the ski lift.

With body 80 mounted to arm 42 of the ski lift in the manner shown in FIG. 8, a ski pole 30 is inserted within formation 82 by placing ski pole 30 horizontally above passage 84 and moving the ski pole laterally and downward with respect to its central axis. Ski pole 30 then passes through passage 84 and into the retention space defined by inner formation 82 to rest on a lower surface 120 of formation 82, the lower surface 120 being the inner surface of lower wall 88. Thus, a ski pole so placed within the body 80 is supported at its rod section 32 from below by surface 120.

Figure 10:
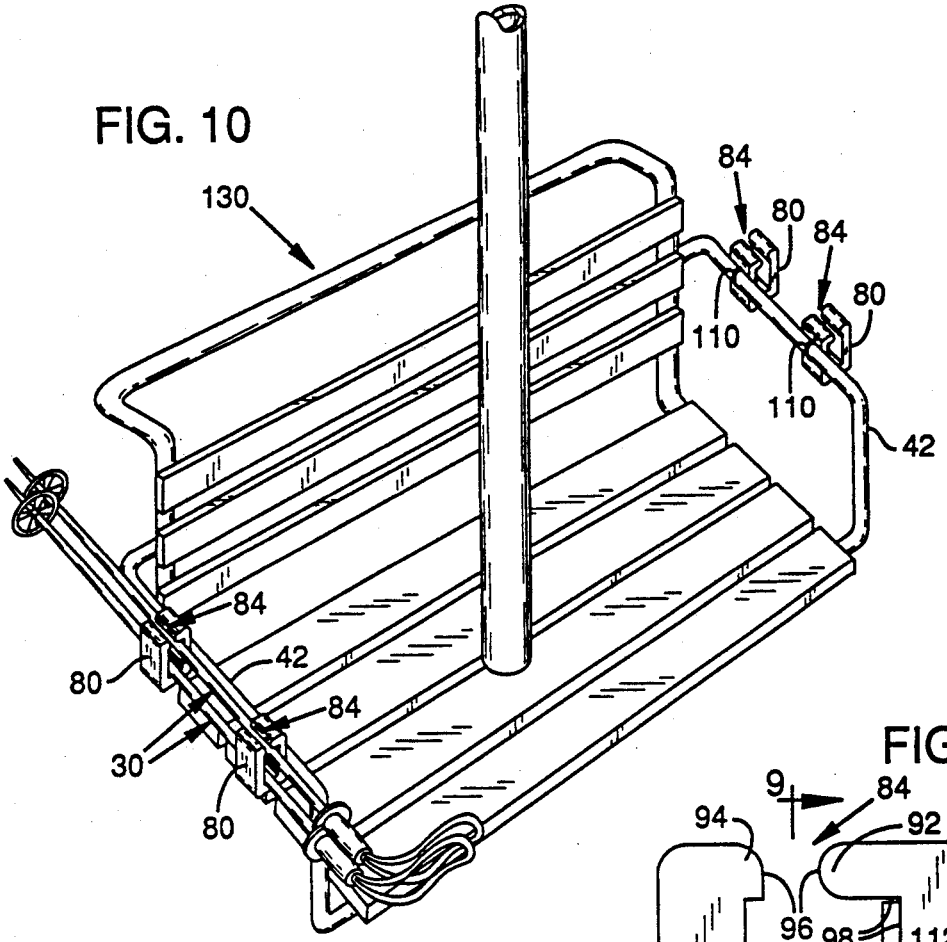
FIG. 10 is a perspective view of an open ski lift and two ski lift holders, such as shown in FIG. 8, holding a pair of ski poles.

FIG. 10 illustrates use of the body 80 of FIG. 8 for securing ski poles to an open ski lift 130. In a preferred use of the present invention, two retainer bodies 80 are mounted to an arm 42 of an open ski lift 130. The bodies 80 should be positioned close enough together in order to each receive the rod section of ski pole 30, yet far enough apart to provide stable support for the ski pole 30. Body 80 is dimensioned to restrict longitudinal movement of poles 30 in order to secure poles 30 within body 80. More particularly, the width of inner formation 82 should be less than the width of the handles 34 and of baskets 36, whereby the handles 34 and baskets 36 cannot enter formation 82 by longitudinal movement of ski poles 30. Also, passage 84 may be slightly less in width than the outer diameter of rod section 32 of ski pole 30. Because body 80 is resilient, rod section 32 may be forced through passage 84, with body 80 giving way or deforming to permit such passage, yet suitably retained against exit from formation 82 by way of passage 84.

It may be appreciated that because ski lift 130 is an open ski lift, it is important that skiers retain a firm grasp on their ski poles 30 while riding the lift. More particularly, if a skier drops one or both poles, the poles fall to the ground. The skier is then without poles, until the skier is able to return to the site of the dropped poles. By use of the present invention, the skier is able to place the ski poles within a holder attached to the ski lift. The ski poles are well secured to the ski lift without requiring the attention of the skier during the ski lift ride. The skier is afforded a more comfortable and relaxing ski lift ride.

In operation, skiers board lift 130 with their poles in hand, and once seated upon the lift, they hold their poles horizontally above the entry passages 84 of bodies 80 and force the ski poles 30 through passages 84 and into the space defined by inner formations 82. The poles are thereby supported horizontally and secured to the ski lift 130 during the ski lift ride.

Because ski poles 30 are supported horizontally, there is little chance that ski poles 30 will strike objects or drag upon the ground. However, if such striking does occur, the resiliency of body 80 will absorb some of this impact and prevent damage to poles 30 or ski lift 130.

Thus, a ski pole holder has been shown which secures a skier's poles while the skier rides a ski lift, thereby freeing the skier from the necessity of holding the poles in hand or sitting upon the poles.

While a preferred embodiment of the present invention has been shown and described, it will be apparent to those skilled in the art that many changes and modifications may be made without departing from the invention in its broader aspects. For example, body 12 may be secured to a ski lift by means other than bolts 22. The appended claims are, therefore, intended to cover all such changes and modifications as fall within the true spirit and scope of the invention.

I claim:

1. In combination, an open ski lift and a holder for a ski pole, the ski pole having a rod section defining a ski pole axis, the rod section coupling a ski pole basket and a ski pole handle each of greater diameter relative to the ski pole axis than the rod section, the ski pole holder comprising:

a first body having an external surface and an inner formation defining a first ski pole retention space, the first retention space being open at first and second opposite ends and otherwise substantially enclosed by said inner formation, the first body further including a first entry passage communicating said external surface and said inner formation, the first entry passage further communicating said first and second ends of said first retention space, the first entry passage sized to permit lateral movement of the rod section of the ski pole through the first entry passage and into the first retention space;

first mounting means for mounting said first body to said open ski lift with said first and second ends substantially horizontally aligned, whereby the ski pole is held horizontally as said rod section comes to rest against an upward facing surface of said inner formation;

a second body having an external surface and an inner formation defining a second ski pole retention space, the second retention space being open at first and second opposite ends and otherwise substantially enclosed by said inner formation of the second body, the second body further including a second entry passage communicating said external surface of the second body and said inner formation of the second body, the second entry passage further communicating said first and second ends of said second retention space, the second entry passage being sized to permit lateral movement of the rod section of the ski pole through the second entry passage and into the second retention space; and second mounting means for mounting said second body to said open ski lift in spaced horizontal alignment with said first body, whereby said first and second bodies cooperate to support the ski pole horizontally as said rod section comes to rest against an upward facing surface of the inner formation of the second body.

2. In combination, an open ski lift and a holder for a ski pole, the ski pole having a rod section defining a ski pole axis, the rod section coupling a ski pole basket and a ski pole handle each of greater diameter relative to the ski pole axis than the rod section, the ski pole holder comprising:

a first body having an external surface and an inner formation defining a first ski pole retention space, the first retention space being open at first and second opposite ends and otherwise substantially enclosed by said inner formation of said first body, the first body further including a first entry passage communicating said external surface and said inner formation of said first body, said first entry passage further communicating said first and second ends of said first retention space, said first entry passage being sized to permit passage of the rod section of the ski pole into the first retaining space by lateral movement of the rod section through the first entry passage whereby a portion of the rod section may be placed within the first retention space with remaining portions of the rod section extending through said first and second ends of said first retention space;

a second body having an external surface and an inner formation defining a second ski pole retention space, the second retention space being open at first and second opposite ends and otherwise substantially enclosed by said inner formation of said second body, the second body further including a second entry passage communicating said external surface and said inner formation of said second body, said second entry passage further communicating said first and second ends of said second retention space, said second entry passage being sized to permit passage of the rod section of the ski pole into the second retention space by lateral movement of the rod section through the second entry passage, whereby a portion of the rod section may be placed within the second retention space with remaining portions of the rod section extending through said first and second ends of said second retention space; and mounting means adapted for mounting said first and second bodies to said open ski lift with the first and second ends of said first and second retention spaces substantially horizontal aligned, whereby the ski pole is supported horizontally by said first and second bodies as said rod section comes to rest against upward facing surfaces of the inner formations of said first and second bodies.

3. The combination according to claim 2, wherein said first and second bodies are resilient and said first and second entry passages are dimensioned to be smaller than the width of the rod section of the ski pole, whereby passage of the rod section of the ski pole through the first and second entry passages causes deformation of said first and second bodies.

4. The holder according to claim 2, wherein at least one of said first and second ends of said first and second retention spaces is dimensioned to prevent entry of the ski pole handle within the ski pole retention space by longitudinal movement of the ski pole relative to the ski pole axis.

* * * * *